US010125619B2

(12) United States Patent
Kray et al.

(10) Patent No.: US 10,125,619 B2
(45) Date of Patent: Nov. 13, 2018

(54) ROTOR ASSEMBLY FOR USE IN A TURBOFAN ENGINE AND METHOD OF ASSEMBLING

(71) Applicant: General Electric Company, Schenectady, NY (US)

(72) Inventors: Nicholas Joseph Kray, Mason, OH (US); Todd Alan Anderson, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 368 days.

(21) Appl. No.: 14/945,670

(22) Filed: Nov. 19, 2015

(65) Prior Publication Data

US 2017/0146020 A1 May 25, 2017

(51) Int. Cl.
*F01D 5/28* (2006.01)
*F01D 5/30* (2006.01)

(52) U.S. Cl.
CPC ..... *F01D 5/30* (2013.01); *F01D 5/282* (2013.01); *F01D 5/3023* (2013.01); *F01D 5/3092* (2013.01); *F05D 2300/603* (2013.01)

(58) Field of Classification Search
CPC ..... F01D 5/30; F01D 5/3023; F01D 5/3092; F01D 5/282; F01D 5/288; F05D 2300/603
See application file for complete search history.

(56) References Cited

U.S. PATENT DOCUMENTS 1,050,119 A 1/1913 Flanders
2,317,338 A 4/1943 Rydmark
2,944,326 A * 7/1960 Stadthaus ..... B21K 25/00 228/136
3,132,841 A * 5/1964 Wilder, Jr. ..... F01D 5/282 416/219 R
3,471,127 A * 10/1969 Emmerson ..... F01D 5/30 416/193 A (Continued)

FOREIGN PATENT DOCUMENTS

CN 1920311 A 2/2007
GB 204038 A * 10/1923 ..... F01D 5/30

(Continued)

OTHER PUBLICATIONS

Extended European Search Report and Opinion issued in connection with corresponding EP Application No. 16198356.4 on Mar. 20, 2017.

(Continued)

*Primary Examiner* — Justin Seabe
*Assistant Examiner* — Brian P Wolcott
(74) *Attorney, Agent, or Firm* — General Electric Company; Brian Overbeck

(57) ABSTRACT

A rotor assembly for use in a turbofan engine is provided. The rotor assembly includes an annular spool including a blade opening defined therein, and a rotor blade radially insertable through the blade opening. The rotor blade includes a rotor blade radially insertable through the blade opening. The rotor blade includes a root portion having a dovetail shape, and the root portion is undersized relative to the blade opening. At least one secondary dovetail member is positioned within the blade opening and configured to couple the root portion within the blade opening with an interference fit.

17 Claims, 4 Drawing Sheets

(56) References Cited

U.S. PATENT DOCUMENTS

| | | | | |
|---|---|---|---|---|
| 3,784,320 | A | 1/1974 | Rossmann et al. | |
| 6,619,924 | B2 | 9/2003 | Miller | |
| 7,290,988 | B2 | 11/2007 | Boston et al. | |
| 8,123,487 | B2 * | 2/2012 | Bayer | C22C 47/00 416/219 R |
| 8,608,446 | B2 | 12/2013 | Pickens et al. | |
| 9,039,379 | B2 | 5/2015 | Radomski | |
| 2007/0048140 | A1 | 3/2007 | Farr et al. | |
| 2010/0158690 | A1 | 6/2010 | Cortequisse et al. | |
| 2014/0079552 | A1 * | 3/2014 | Englebert | F01D 5/3053 416/193 A |
| 2016/0130957 | A1 * | 5/2016 | Freeman | F01D 5/3061 416/193 R |
| 2016/0177752 | A1 * | 6/2016 | Brandl | F01D 5/225 416/221 |

FOREIGN PATENT DOCUMENTS

| | | | | | |
|---|---|---|---|---|---|
| GB | 776618 | A | * | 6/1957 | F01D 5/3038 |
| GB | 1 080 026 | A | | 8/1967 | |
| GB | 1080026 | A | * | 8/1967 | F01D 5/26 |

OTHER PUBLICATIONS

Machine translation and Office Action issued in connection with corresponding CN Application No. 01611016284.9 dated Jul. 24, 2018.

* cited by examiner

ROTOR ASSEMBLY FOR USE IN A TURBOFAN ENGINE AND METHOD OF ASSEMBLING

BACKGROUND

The present disclosure relates generally to turbofan engines and, more specifically, to systems and methods of retaining rotor blades engaged with an annular spool.

At least some known gas turbine engines, such as turbofan engines, include a fan, a core engine, and a power turbine. The core engine includes at least one compressor, a combustor, and a high-pressure turbine coupled together in a serial flow relationship. More specifically, the compressor and high-pressure turbine are coupled through a first drive shaft to form a high-pressure rotor assembly. Air entering the core engine is mixed with fuel and ignited to form a high energy gas stream. The high energy gas stream flows through the high-pressure turbine to rotatably drive the high-pressure turbine such that the shaft rotatably drives the compressor. The gas stream expands as it flows through a power or low-pressure turbine positioned aft of the high-pressure turbine. The low-pressure turbine includes a rotor assembly having a fan coupled to a second drive shaft. The low-pressure turbine rotatably drives the fan through the second drive shaft.

Many modern commercial turbofans include a low-pressure compressor, also referred to as a booster, positioned aft of the fan and coupled along the second drive shaft. The low-pressure compressor includes a booster spool and a plurality of rotor blades either formed integrally with or coupled to the booster spool with one or more retaining features. For example, the rotor blades may be individually inserted into and rotated circumferentially within a circumferential slot defined within the booster spool for positioning the rotor blades in a final seated position. However, as components of the turbine engine are increasingly being fabricated from lightweight materials, such as carbon fiber reinforced polymer (CFRP), more efficient and weight effective means for retaining rotor blades may be desired.

BRIEF DESCRIPTION

In one aspect, a rotor assembly for use in a turbofan engine is provided. The rotor assembly includes an annular spool including a blade opening defined therein, and a rotor blade radially insertable through the blade opening. The rotor blade includes a root portion having a dovetail shape, and the root portion is undersized relative to the blade opening. At least one secondary dovetail member is positioned within the blade opening and configured to couple the root portion within the blade opening with an interference fit.

In another aspect, a turbofan engine is provided. The turbofan engine includes a low-pressure compressor including an annular spool that includes a blade opening defined therein, and a rotor blade radially insertable through the blade opening. The rotor blade includes a root portion having a dovetail shape, and the root portion is undersized relative to the blade opening. At least one secondary dovetail member is positioned within the blade opening and configured to couple the root portion within the blade opening with an interference fit.

In yet another aspect, a method of assembling a rotor assembly for use in a turbofan engine is provided. The method includes defining a blade opening within an annular spool, and inserting a rotor blade through the blade opening from a radially inner side of the annular spool. The rotor blade includes a root portion having a dovetail shape, and the root portion is undersized relative to the blade opening. The method also includes positioning at least one secondary dovetail member within the blade opening. The at least one secondary dovetail member is sized such that the root portion is coupled within the blade opening with an interference fit.

DRAWINGS

These and other features, aspects, and advantages of the present disclosure will become better understood when the following detailed description is read with reference to the accompanying drawings in which like characters represent like parts throughout the drawings, wherein.

Figure 1:
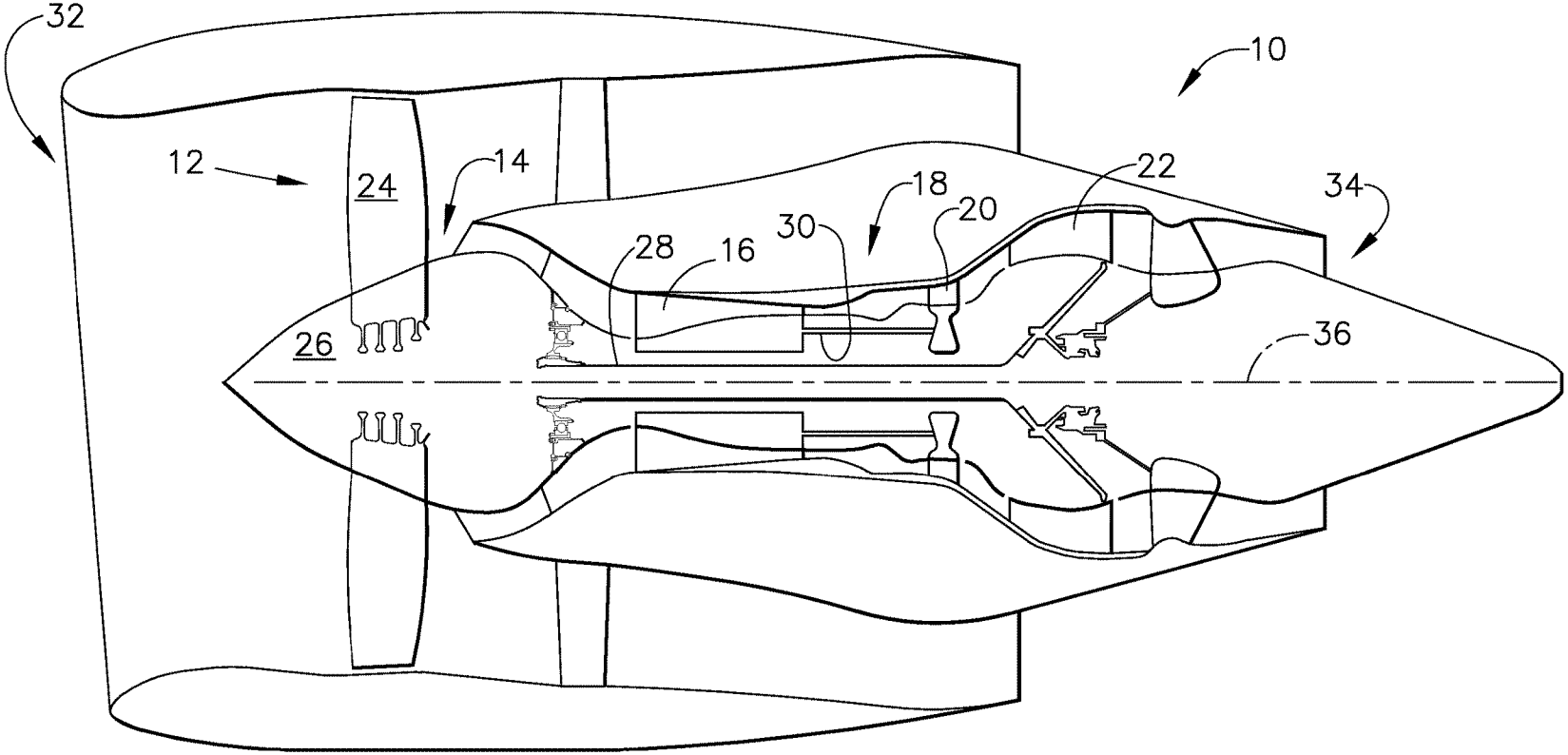
FIG. 1 is a schematic illustration of an exemplary turbofan engine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Embodiments of the present disclosure relate to turbine engines, such as turbofans, and methods of manufacturing thereof. More specifically, the turbine engines described herein include an annular spool including a plurality of blade openings for receiving radially insertable rotor blades therethrough. The rotor blades include a root portion having a retaining feature, such as a dovetail shape. The root portion is formed undersized relative to the blade opening to facilitate increasing the weight efficiency and manufacturability of the rotor blade. The rotor assembly also includes at least one secondary dovetail member positioned within the blade opening to ensure the rotor blades remain securely coupled therein. When fabricated from multiple layers of composite material, forming the rotor blades with a large root portion may be a complex and laborious process. As such, the at least one secondary dovetail member facilitates properly seating the rotor blades within the blade openings while also reducing the complexity of assembling the rotor assembly, and reducing the complexity of fabricating the rotor blades.

FIG. 1 is a schematic illustration of an exemplary turbofan engine 10 including a fan assembly 12, a low pressure or booster compressor 14, a high-pressure compressor 16, and a combustor assembly 18. Fan assembly 12, booster compressor 14, high-pressure compressor 16, and combustor assembly 18 are coupled in flow communication. Turbofan engine 10 also includes a high-pressure turbine 20 coupled in flow communication with combustor assembly 18 and a low-pressure turbine 22. Fan assembly 12 includes an array of fan blades 24 extending radially outward from a rotor disk 26. Low-pressure turbine 22 is coupled to fan assembly 12 and booster compressor 14 via a first drive shaft 28, and high-pressure turbine 20 is coupled to high-pressure compressor 16 via a second drive shaft 30. Turbofan engine 10 has an intake 32 and an exhaust 34. Turbofan engine 10 further includes a centerline 36 about which fan assembly 12, booster compressor 14, high-pressure compressor 16, and turbine assemblies 20 and 22 rotate.

In operation, air entering turbofan engine 10 through intake 32 is channeled through fan assembly 12 towards booster compressor 14. Compressed air is discharged from booster compressor 14 towards high-pressure compressor 16. Highly compressed air is channeled from high-pressure compressor 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from turbofan engine 10 via exhaust 34.

Figure 2:
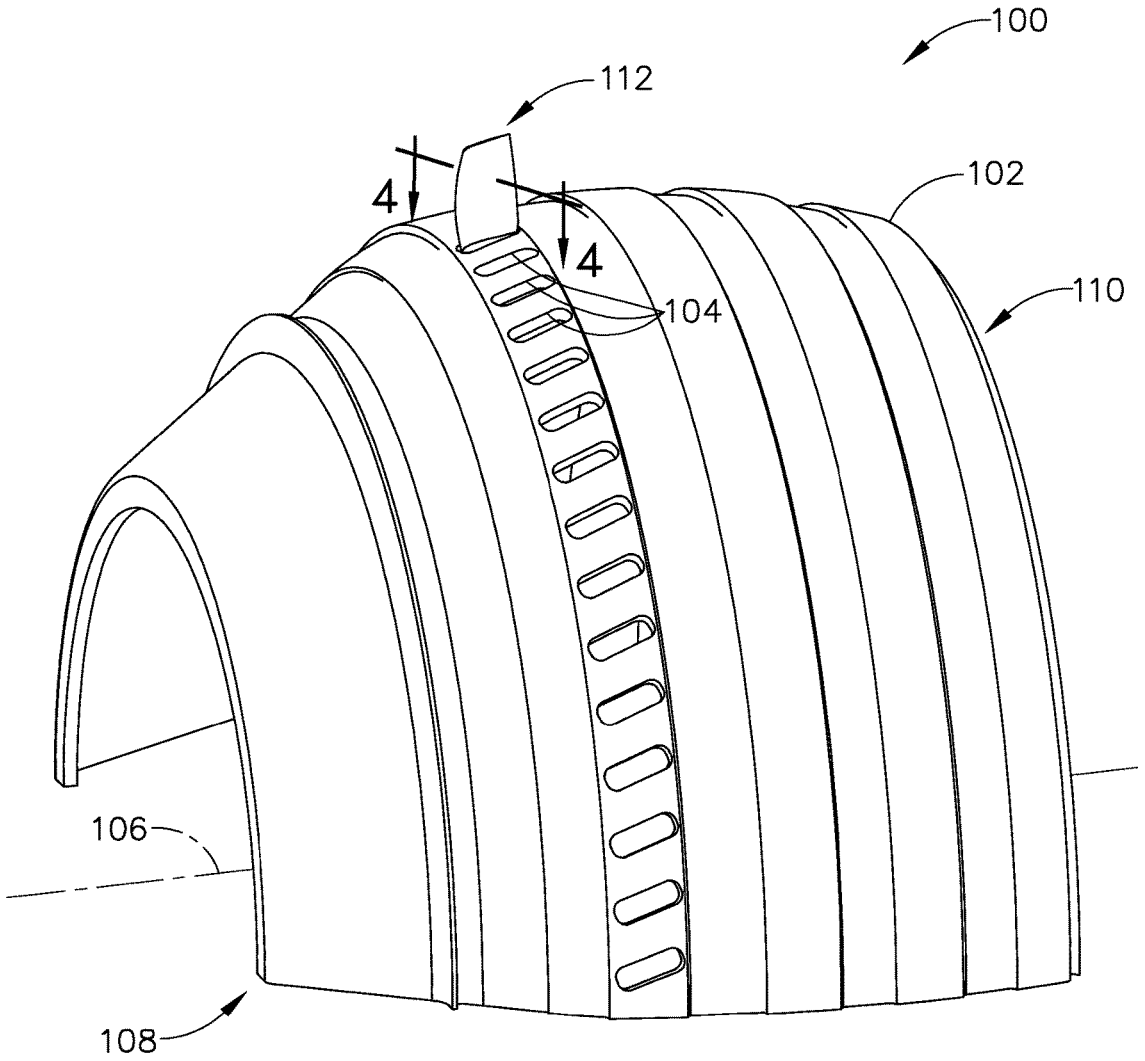
FIG. 2 is a partial perspective view of an exemplary rotor assembly that may be used in the turbofan engine shown in FIG. 1.

FIG. 2 is a partial perspective view of an exemplary rotor assembly 100 that may be used in turbofan engine 10 (shown in FIG. 1). In the exemplary embodiment, rotor assembly 100 includes an annular spool 102 including a plurality of blade openings 104 defined therein. More specifically, blade openings 104 are spaced circumferentially about a centerline 106 of annular spool 102. Annular spool 102 also includes a forward first end 108 and an aft second end 110 having a greater radial size than first end 108. In one embodiment, rotor assembly 100 is designed for use in booster compressor 14 (shown in FIG. 1). As such, when used in booster compressor 14, annular spool 102 is oriented such that first end 108 is located proximate fan assembly 12 and second end 110 is located proximate high-pressure compressor 16. Moreover, while shown as having a semi-circular shape, it should be understood that annular spool 102 may either be formed from a fully annular structure or formed from two or more arcuate sections coupled together to form the fully annular structure.

Rotor assembly 100 also includes at least one rotor blade 112 radially insertable through each blade opening 104. As will be described in more detail below, blade openings 104 are oversized relative to a retaining feature of rotor blades 112. More specifically, in the exemplary embodiment, at least a portion of rotor blades 112 have a twisted profile, thereby causing the orientation of rotor blades 112 to be modified while being radially inserted through blade openings 104. As such, the asymmetric shape of rotor blades 112 causes blade openings 104 to be oversized relative to rotor blades 112.

Figure 3:
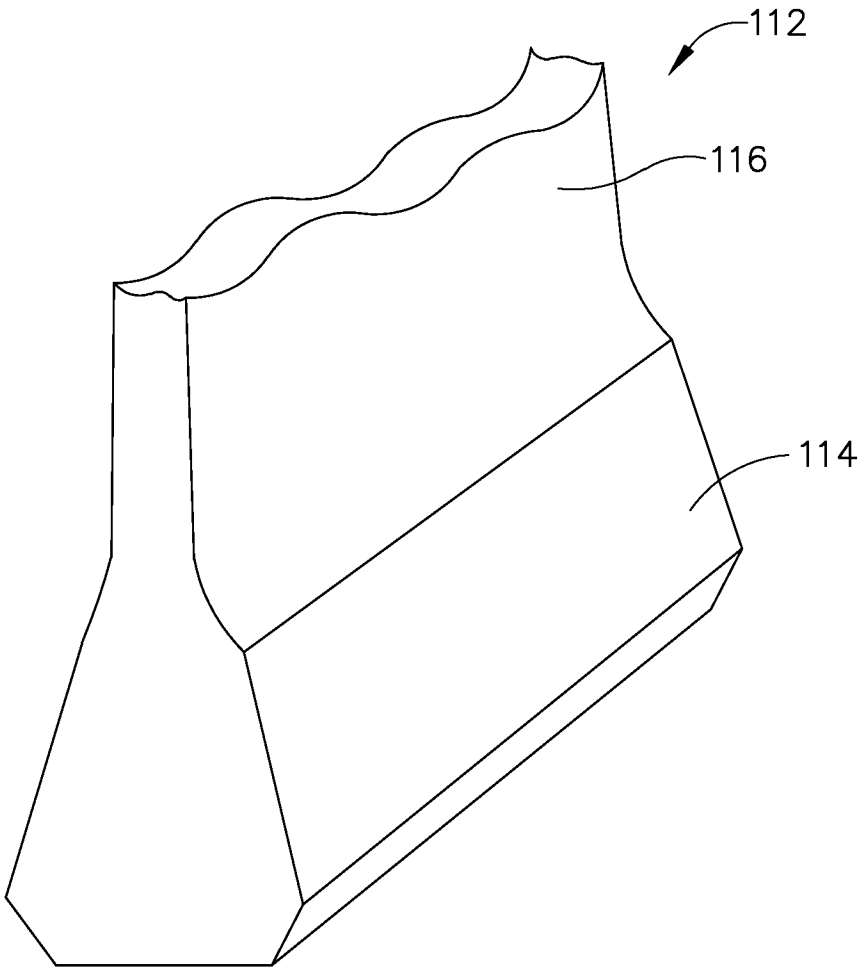
FIG. 3 is a partial perspective view of an exemplary rotor blade that may be used with the rotor assembly shown in FIG. 2.
Figure 4:
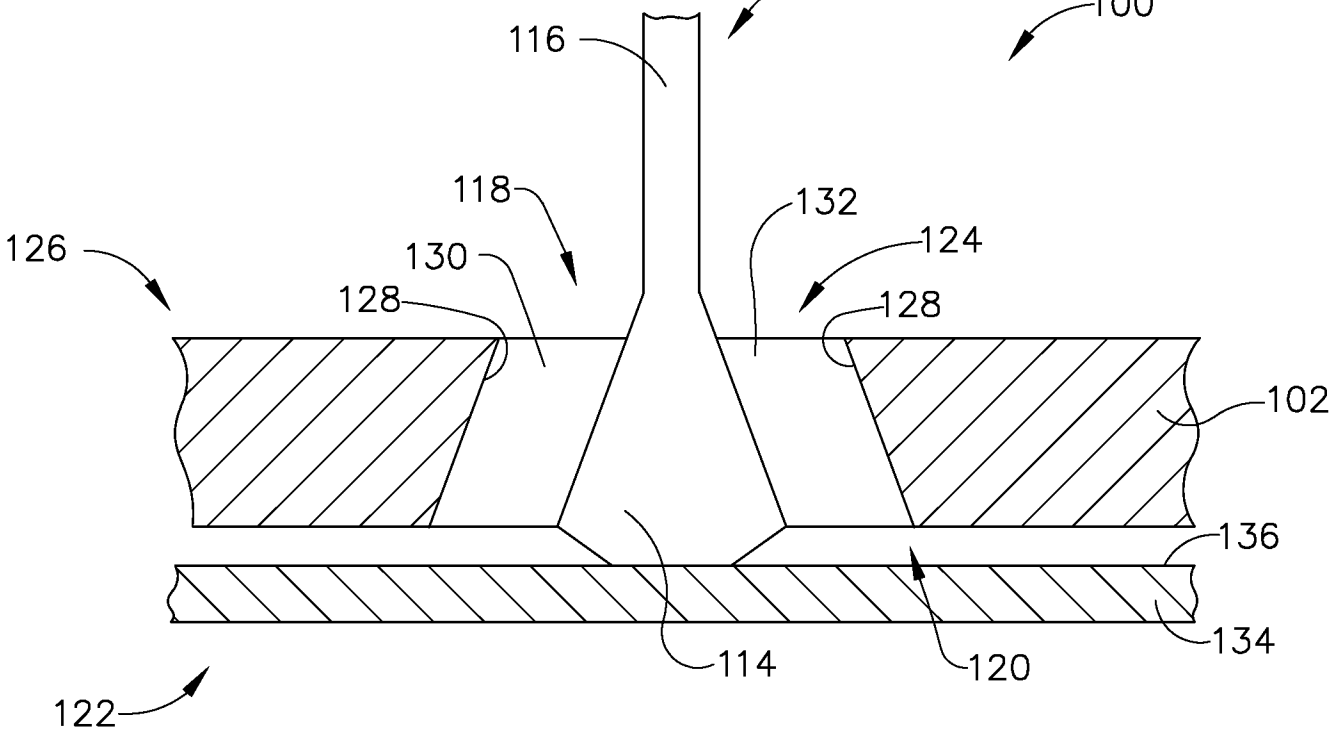
FIG. 4 is a cross-sectional view of an exemplary portion of the rotor assembly shown in FIG. 2, taken along Lines 4-4.

FIG. 3 is a partial perspective view of an exemplary rotor blade 112 that may be used with rotor assembly 100 (shown in FIG. 2), and FIG. 4 is a cross-sectional view of an exemplary portion of rotor assembly 100, taken along Lines 4-4. Referring to FIG. 3, in the exemplary embodiment, rotor blade 112 includes a root portion 114 and a blade portion 116 extending from root portion 114. As described above, blade portion 116 has a twisted profile (not shown). Moreover, root portion 114 includes a retaining feature for ensuring rotor blade 112 remains properly seated within blade openings 104 (shown in FIG. 2) during operation of rotor assembly 100. Root portion 114 may include any retaining feature that enables rotor assembly 100 to function as described herein. In the exemplary embodiment, root portion 114 has a dovetail shape and is undersized relative to blade openings 104. The dovetail shape is tapered to facilitate counteracting the centrifugal force caused by rotation of annular spool 102 with a smooth load transition between root portion 114 and surrounding structures.

Referring to FIG. 4, rotor blade 112 is radially inserted within blade opening 104, and rotor assembly 100 further includes at least one secondary dovetail member 118 positioned within blade opening 104. More specifically, blade opening 104 includes a blade inlet 120 defined at a radially inner portion 122 of annular spool 102, and a blade outlet 124 defined at a radially outer portion 126 of annular spool 102. Blade inlet 120 has a greater size than blade outlet 124, and blade opening 104 progressively decreases in cross-sectional size from blade inlet 120 towards blade outlet 124. As described above, root portion 114 of rotor blade 112 is undersized relative to blade opening 104 such that at least one gap (not shown) is defined between root portion 114 and a side wall 128 of blade opening 104. In one embodiment, root portion 114 is undersized relative to blade outlet 124 such that the retaining feature of root portion 114 is unable to retain rotor blade 112 within blade opening 104.

In the exemplary embodiment, the at least one secondary dovetail member 118 is positioned within blade opening 104 to fill the at least one gap defined between root portion 114 and side wall 128 of blade opening 104. More specifically, the at least one secondary dovetail member 118 includes a first secondary dovetail member 130 and a second secondary dovetail member 132 positioned on opposing sides of root portion 114 within blade opening 104, such that first and second secondary dovetail members 130 and 132 are positioned between root portion 114 and side wall 128. The at least one secondary dovetail member 118 is sized such that root portion 114 is coupled within blade opening 104 with an interference fit. For example, secondary dovetail members 118 have a thickness and are contoured to ensure rotor blade 112 is securely coupled within blade opening 104. As such, in operation, the centrifugal force caused by rotation of annular spool 102 causes root portion 114 to bias against secondary dovetail members 118 in a radially outward direction, which causes secondary dovetail members 118 to bias against side walls 128 of blade opening 104 and secure rotor blade 112 within blade opening 104. In an alternative embodiment, a single secondary dovetail member 118 is positioned within blade opening 104 such that the single secondary dovetail member 118 is coupled between side wall 128 and root portion 114 on a first side thereof, and root portion 114 is coupled directly to side wall 128 on an opposite side of root portion 114.

Rotor blades 112 and secondary dovetail members 118 may be fabricated from any material that enables rotor assembly 100 to function as described herein. In the exemplary embodiment, rotor blades 112 and secondary dovetail members 118 are formed from similar material to ensure compatibility therebetween. For example, when rotor blades 112 are formed from a non-metallic material, such as carbon fiber reinforced polymer (CFRP), secondary dovetail members 118 are likewise formed from a non-metallic material. However, rotor blades 112 and secondary dovetail members 118 need not be fabricated from the same non-metallic material. In the exemplary embodiment, the material used to fabricate secondary dovetail members 118 is lightweight, and has favorable compression modulus characteristics. In one embodiment, the material used to fabricate secondary dovetail members 118 is less dense than the material used to fabricate rotor blade 112 to facilitate increasing the weight efficiency of rotor assembly 100. Exemplary materials that may be used to fabricate secondary dovetail members 118 include, but are not limited to, composite material, thermoplastic material, and plastic material. In an alternative embodiment, rotor blades 112 are fabricated from a metallic material and secondary dovetail members 118 are likewise fabricated from a metallic material.

In the exemplary embodiment, rotor assembly 100 also includes a retaining member 134 positioned radially inward from rotor blade 112. In operation, when annular spool 102 rotates at a speed less than a predetermined threshold, the centrifugal force that caused root portion 114 to bias against secondary dovetail members 118 is incapable of maintaining rotor blade 112 within blade opening 104. Retaining member 134 is positioned to restrict radial movement of rotor blade 112 relative to annular spool 102. More specifically, in one embodiment, retaining member 134 has a substantially annular shape and includes a radially outer surface 136 that biases against root portion 114 of rotor blade 112. As such, retaining member 134 facilitates maintaining rotor blade 112 within blade opening 104 when the rotational speed of annular spool 102 is less than the predetermined threshold.

A method of assembling rotor assembly 100 for use in turbofan engine 10 is also described herein. The method includes defining blade opening 104 within annular spool 102, and inserting rotor blade 112 through blade opening 104 from a radially inner side of annular spool 102. Rotor blade 112 includes root portion 114 having a dovetail shape, and root portion 114 is undersized relative to blade opening 104. The method also includes positioning at least one secondary dovetail member 118 within a respective blade opening 104. The at least one secondary dovetail member 118 is sized such that root portion 114 is coupled within blade opening 104 with an interference fit.

An exemplary technical effect of the system and methods described herein includes at least one of: (a) reducing the overall weight of a turbofan engine; (b) reducing the time and complexity required to assemble a rotor assembly including individual rotor blades; (c) enabling the incorporation of composite material within a booster compressor of a turbofan engine; (d) improving the damping characteristics of the assembly due to improved dissipation from the use of composite/polymer materials; and (e) reducing the complexity of the maintenance and service of individual rotor blades in the spool.

Exemplary embodiments of a turbofan engine and related components are described above in detail. The system is not limited to the specific embodiments described herein, but rather, components of systems and/or steps of the methods may be utilized independently and separately from other components and/or steps described herein. For example, the configuration of components described herein may also be used in combination with other processes, and is not limited to practice with only turbofan engines and related methods as described herein. Rather, the exemplary embodiment can be implemented and utilized in connection with many applications where easily assembling a rotor assembly is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A rotor assembly for use in a turbofan engine, said rotor assembly comprising:

an annular spool comprising a blade opening defined therein;

a rotor blade radially insertable through said blade opening, said rotor blade comprising a root portion having a dovetail shape, and wherein said root portion is undersized relative to said blade opening, wherein said blade opening comprises a blade inlet defined at a radially inner portion of said annular spool, and a blade outlet defined at a radially outer portion of said annular spool, wherein said blade opening progressively decreases in cross-sectional size from said blade inlet towards said blade outlet; and at least one secondary dovetail member positioned within said blade opening and configured to couple said root portion within said blade opening with an interference fit.

2. The rotor assembly in accordance with claim 1, wherein said root portion is undersized relative to said blade outlet.

3. The rotor assembly in accordance with claim 1 further comprising a retaining member positioned radially inward from said rotor blade, said retaining member positioned to restrict radial movement of said rotor blade relative to said annular spool.

4. The rotor assembly in accordance with claim 3, wherein said retaining member extends circumferentially about a radially inner portion of said annular spool.

5. The rotor assembly in accordance with claim 1, wherein said at least one secondary dovetail member comprises a first secondary dovetail member and a second secondary dovetail member positioned on opposing sides of said root portion within said blade opening.

6. The rotor assembly in accordance with claim 1, wherein said rotor blade is fabricated from a non-metallic material.

7. The rotor assembly in accordance with claim 1, wherein said rotor blade and said at least one secondary dovetail are fabricated from a non-metallic material.

8. A turbofan engine comprising:

a low-pressure compressor comprising:

an annular spool comprising a blade opening defined therein;

a rotor blade radially insertable through said blade opening, said rotor blade comprising a root portion having a dovetail shape, and wherein said root portion is undersized relative to said blade opening, wherein said blade opening comprises a blade inlet defined at a radially inner portion of said annular spool, and a blade outlet defined at a radially outer portion of said annular spool, wherein said blade opening progressively decreases in cross-sectional size from said blade inlet towards said blade outlet; and at least one secondary dovetail member positioned within said blade opening and configured to couple said root portion within said blade opening with an interference fit.

9. The turbofan engine in accordance with claim 8, wherein said root portion is undersized relative to said blade outlet.

10. The turbofan engine in accordance with claim 8 further comprising a retaining member positioned radially inward from said rotor blade, wherein said retaining member is positioned to restrict radial movement of said rotor blade relative to said annular spool.

11. The turbofan engine in accordance with claim 10, wherein said retaining member extends circumferentially about a radially inner portion of said annular spool.

12. The turbofan engine in accordance with claim 8, wherein said at least one secondary dovetail member comprises a first secondary dovetail member and a second secondary dovetail member positioned on opposing sides of said root portion within said blade opening.

13. The turbofan engine in accordance with claim 8, wherein said rotor blade is fabricated from a non-metallic material.

14. A method of assembling a rotor assembly for use in a turbofan engine, said method comprising:

defining a blade opening within an annular spool comprising defining a blade inlet at a radially inner portion of the annular spool and defining a blade outlet at a radially outer portion of the annular spool, wherein the blade opening progressively decreases in cross-sectional size from the blade inlet towards the blade outlet;

inserting a rotor blade through the blade opening from a radially inner side of the annular spool, wherein the rotor blade includes a root portion having a dovetail shape, and wherein the root portion is undersized relative to the blade opening; and positioning at least one secondary dovetail member within the blade opening, the at least one secondary dovetail member sized such that the root portion is coupled within the blade opening with an interference fit.

15. The method in accordance with claim 14 further comprising positioning a retaining member radially inward from the rotor blade, wherein the retaining member is positioned to restrict radial movement of the rotor blade relative to the annular spool.

16. The method in accordance with claim 15 further comprising extending the retaining member circumferentially about a radially inner portion of the annular spool.

17. The method in accordance with claim 14, wherein positioning at least one secondary dovetail member comprises positioning a first secondary dovetail member and a second secondary dovetail member on opposing sides of the root portion within the blade opening.

* * * * *